US008052465B1

(12) United States Patent
Chawgo

(10) Patent No.: US 8,052,465 B1
(45) Date of Patent: Nov. 8, 2011

(54) CABLE CONNECTOR EXPANDING CONTACT

(75) Inventor: Shawn M. Chawgo, Cicero, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 13/030,777

(22) Filed: Feb. 18, 2011

(51) Int. Cl.
*H01R 13/40* (2006.01)

(52) U.S. Cl. ..... 439/578

(58) Field of Classification Search ..... 439/587, 439/594–596, 583–584, 320
See application file for complete search history.

(56) References Cited

U.S. PATENT DOCUMENTS

| | | | | |
|---|---|---|---|---|
| 3,706,958 | A | 12/1972 | Blanchenot | |
| 3,744,011 | A | 7/1973 | Blanchenot | |
| 3,764,959 | A | 10/1973 | Toma et al. | |
| 3,846,738 | A | 11/1974 | Nepovim | |
| 4,346,958 | A | 8/1982 | Blanchard | |
| 4,384,758 | A | 5/1983 | Lee et al. | |
| 4,834,676 | A | 5/1989 | Tackett | |
| 5,066,249 | A | 11/1991 | Doye et al. | |
| 5,362,251 | A | 11/1994 | Bielak | |
| 5,435,745 | A * | 7/1995 | Booth | 439/584 |
| 5,518,420 | A | 5/1996 | Pitschi | |
| 6,095,828 | A * | 8/2000 | Burland | 439/98 |
| 6,133,532 | A | 10/2000 | Lundback et al. | |
| 6,267,621 | B1 | 7/2001 | Pitschi et al. | |
| 6,331,123 | B1 | 12/2001 | Rodrigues | |
| 6,431,911 | B2 | 8/2002 | Pitschi | |
| 6,478,618 | B2 | 11/2002 | Wong | |
| 6,517,379 | B2 | 2/2003 | Leve | |
| 6,634,906 | B1 | 10/2003 | Yeh | |
| 6,705,884 | B1 | 3/2004 | McCarthy | |
| 6,796,829 | B1 | 9/2004 | McCarthy | |
| 6,848,941 | B2 | 2/2005 | Wlos et al. | |
| 6,884,113 | B1 | 4/2005 | Montena | |
| 6,955,561 | B2 | 10/2005 | Seymour et al. | |
| 6,955,562 | B1 | 10/2005 | Henningsen | |
| 7,008,264 | B2 | 3/2006 | Wild | |
| 7,131,868 | B2 | 11/2006 | Montena | |
| 7,311,554 | B1 * | 12/2007 | Jackson et al. | 439/584 |
| 7,357,671 | B2 | 4/2008 | Wild et al. | |
| 7,458,851 | B2 * | 12/2008 | Montena | 439/584 |
| 7,527,512 | B2 * | 5/2009 | Montena | 439/265 |
| 7,588,460 | B2 * | 9/2009 | Malloy et al. | 439/578 |
| 2007/0105439 | A1 | 5/2007 | Burris et al. | |
| 2008/0261445 | A1 * | 10/2008 | Malloy et al. | 439/578 |
| 2009/0269979 | A1 * | 10/2009 | Montena | 439/578 |

* cited by examiner

*Primary Examiner* — Tulsidas Patel
*Assistant Examiner* — Phuong Nguyen
(74) *Attorney, Agent, or Firm* — Stephen R. Yoder, Esq.

(57) ABSTRACT

A coaxial cable connector includes a pin having a first end, a second end, and a plurality of circumferentially spaced support arms terminating at the second end. The support arms have inward facing surfaces defining an internal cavity. A guide is axially received in the internal cavity. The guide has tabs at a first end of the guide and a radially extending flange at a second end of the guide. The radially extending flange has an electrically conductive contact surface that contacts the inward facing surface of each of the support arms.

10 Claims, 13 Drawing Sheets

CABLE CONNECTOR EXPANDING CONTACT

FIELD OF THE INVENTION

This invention relates generally to the field of coaxial cable connectors and more particularly to a contact assembly within a connector for use with coaxial cables having a tubular center conductor.

BACKGROUND OF THE INVENTION

Some coaxial cables, typically referred to as hard line coaxial cables, include a center conductor constructed of a smooth-walled or corrugated, metallic (e.g., copper, aluminum, steel, copper clad aluminum, etc.) tube, the material selection depending on weight, cost, flexibility, etc. Such a center conductor is referred to herein as a tubular center conductor.

A tubular center conductor typically includes a hollow internal portion. Electrical connections to the tubular center conductor may be made within the hollow internal portion, because the electromagnetic signals within the coaxial cable pass using mainly the outer diametral portions of the tubular center conductor. Accordingly, coaxial cable connectors that are designed to work with such hard line coaxial cables typically include contacts that are extended within the hollow internal portion of the tubular center conductor. Such coaxial cable connectors are referred to herein as hard line connectors.

The contacts used in many of these hard line connectors are held against the hollow internal portion by a support arm. Each of these contacts is located at or near an end of the support arm, which is cantilevered from a mounting position within the hard line connector. During installation, each of these support arms, along with its respective contact, is deflected to a smaller effective diameter during installation into the hollow internal portion. The amount of deflection may vary greatly.

Each support arm is designed with a limit of elastic deflection that allows an amount of elastic deflection before the support arm is plastically deformed. The limit of elastic deflection accounts for a range of possible variations occurring within a single tubular center conductor or between different tubular center conductors. These variations are typically small, and may include manufacturing tolerances and design variations. When a tubular center conductor is corrugated, though, the variations within a single tubular center conductor or between different tubular center conductors can be significantly large. The limit of elastic deflection is less able to allow for significantly large variations. It has been observed that many of these significantly large variations cause the support arms to deflect beyond their limits of elastic deflection and become plastically deformed during installation. Once the support arm is plastically deformed, it will not return to its original position after a deflection.

Any plastic deformation of the support arms may result in a poor electrical connection between the contacts and the hollow internal portion of the tubular center conductor. As described above, each contact may be held against the hollow internal portion by a respective support arm. An amount of pressure applied by each contact is determined by the amount of elastic deflection between a free-state position of each support arm and an installed-state position of the support arm. Accordingly, any amount of plastic deformation of the support arm during installation will result in a reduced free-state position and, therefore, a reduced pressure applied by each contact.

Previous attempts have been made to increase the amount of elastic deflection available to each support arm by reducing the cross sectional thickness of the support arm. This reduction in the cross sectional thickness naturally allows for greater elastic deflections before the support arm becomes plastically deformed. It is important to note, however, that this reduction in the cross sectional thickness correspondingly reduces the amount of pressure applied to the contact. Any reduction in, or elimination of the amount of pressure applied to the contact may reduce the quality of the connection and degrade the signal.

Other attempts have been made to increase the amount of pressure applied to the contact by various methods, such as increasing the cross sectional thickness of each support arm and using more resilient materials. This increase in the amount of pressure comes with a strong disadvantage of increasing an amount of moving force required to install the contact assembly into the hollow internal portion of the tubular center conductor. This increased installation force may result in damaged contacts and/or an incomplete installation. Both of these outcomes may reduce the quality of the connection and degrade the signal.

The quality of the electrical connection between the contacts and the hollow internal portion of the tubular center conductor can also be affected by the axial variation of the points of contact. While the helical corrugations provide structural stability during bending of the coaxial cable and the tubular center conductor, the helical corrugations also provide a non-regular surface against which the contacts make contact. Particularly with 1¼ inch or 1⅝ inch cables, but also with other sized helical and/or corrugated cables, one or more contacts around the radius of the center tubular conductor are likely to contact the center tubular conductor at different axial locations along the length of the contact. For instance, one contact might contact the center tubular conductor at a first end of the respective contact, while another contact, or portion of the same contact, might contact the center tubular conductor at a second end of the respective contact opposite the first end in the axial direction. The contact that contacts the center tubular conductor at the second end of the contact can produce an undesirable RF effect on the performance of the connector. A "hanging" reverse path for RF propagation is created, which acts like a resonating stub. This effect can reduce the overall transmission efficiency of the connector, and result in the appearance of a periodic phantom high and low impedance downstream of the contact when viewing the connector and the coaxial cable in a time domain.

SUMMARY OF THE INVENTION

The present invention helps to increase the quality of the connections made between the coaxial cable and the connectors. In accordance with one embodiment of the present invention, a coaxial cable connector is provided that includes a pin and a guide. The pin has a first end, a second end, and a plurality of circumferentially spaced support arms terminating at the second end. Inward facing surfaces of the support arms define an internal cavity. The guide is axially received in the internal cavity. The guide has a plurality of tabs at a first end of the guide which fit into respective slots formed between the support arms. The guide has a second end with a radially extending flange. The radially extending flange has an electrically conductive contact surface that contacts the inward facing surface of each of the support arms.

In accordance with one embodiment of the present invention, a coaxial cable connector is provided that includes a pin, a first guide, and a second guide. The pin has a first end, a second end, and a plurality of circumferentially spaced support arms terminating at the second end. Inward facing surfaces of the support arms define an internal cavity. The first guide portion is axially received in the internal cavity. The first guide has a plurality of tabs which fit into respective slots formed between the support arms. The second guide has an insertion end and a flanged end opposite the insertion end. The insertion end is axially received in the first guide, and the flanged end has a generally radially extending flange. The radially extending flange has an electrically conductive contact surface that contacts the inward facing surfaces of the support arms.

BRIEF DESCRIPTION OF THE DRAWINGS

For a further understanding of the nature and objects of the invention, references should be made to the following detailed description of a preferred mode of practicing the invention, read in connection with the accompanying drawings in which.

DETAILED DESCRIPTION OF THE INVENTION

Figure 1:
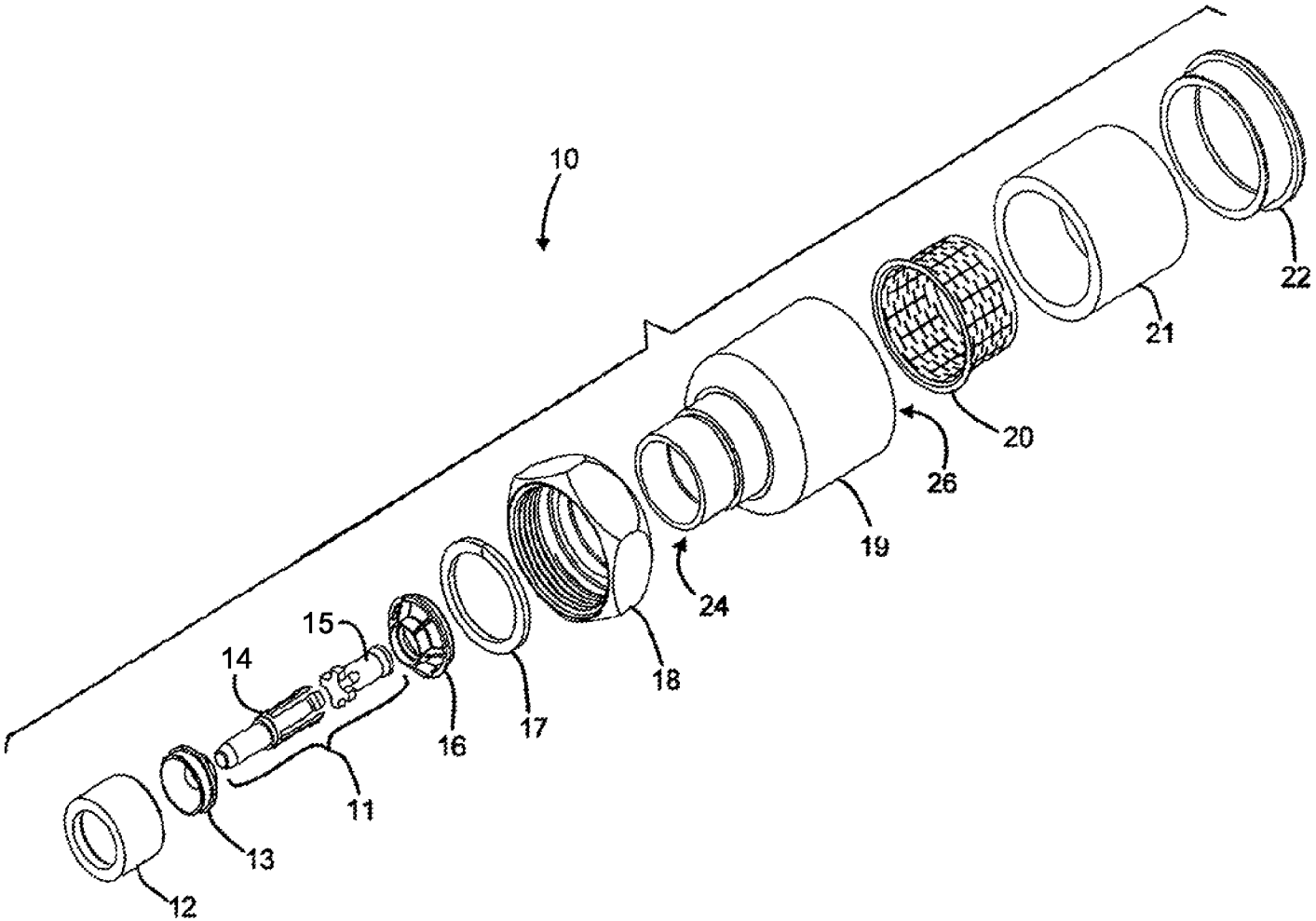
FIG. 1 shows a perspective exploded view of the parts of a hard line connector according to an embodiment of the invention.

Referring to FIG. 1, a hard line connector 10 according to an embodiment of the invention is shown in exploded form. The connector 10 includes a fastener 18 axially assembled onto a forward end 24 of an outer body 19. The fastener 18 is held on the outer body 19 using a snap ring 17, such that the fastener 18 can rotate in relation to the outer body 19.

A mesh body 20 and an elastomeric clamp 21 are inserted into a rearward end 26 of the outer body 19. A compression sleeve 22 is then placed in the rearward end 26 of the outer body 19.

Figure 6:
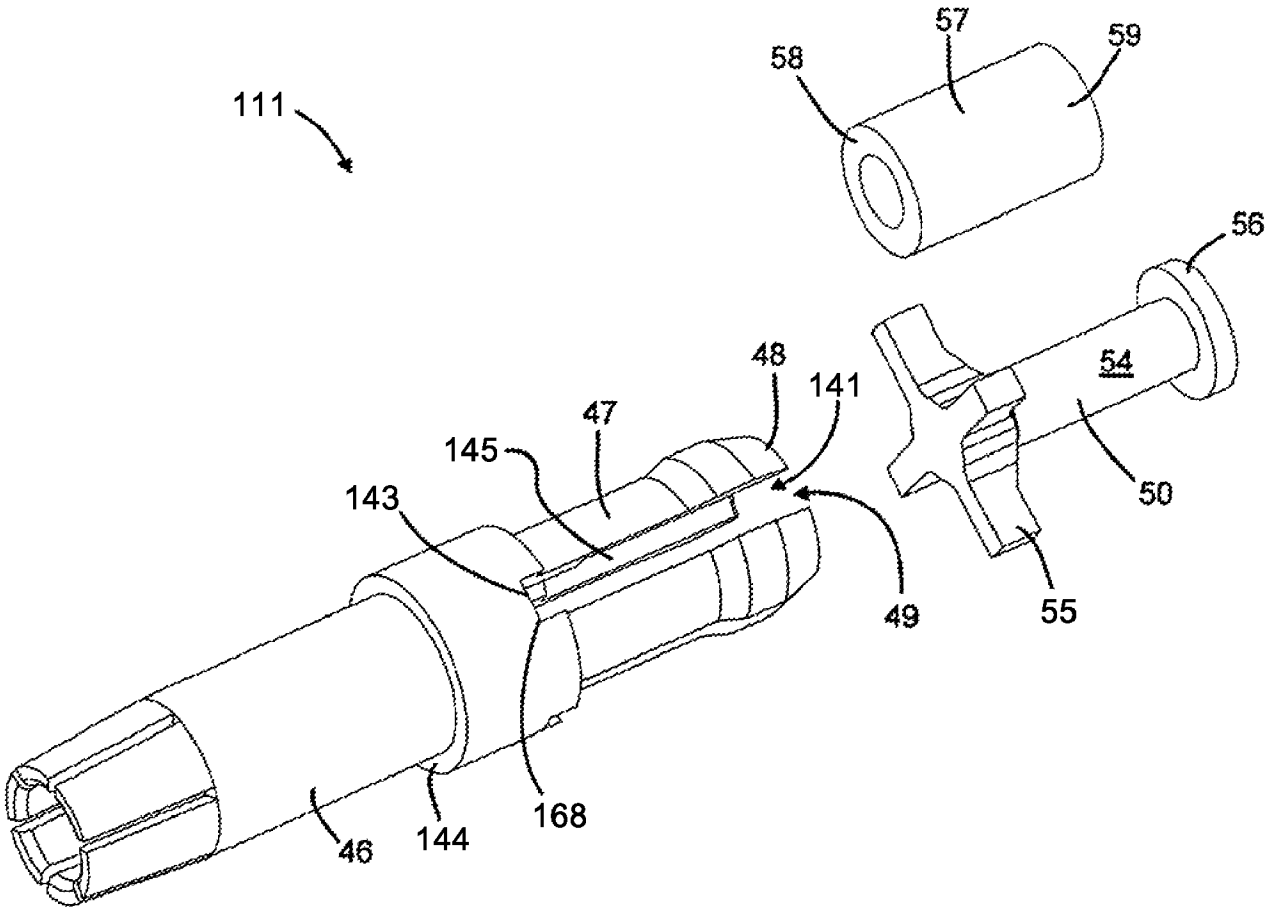
FIG. 6 shows a perspective exploded view of a contact assembly according to an alternative embodiment of the present invention.
Figure 11:
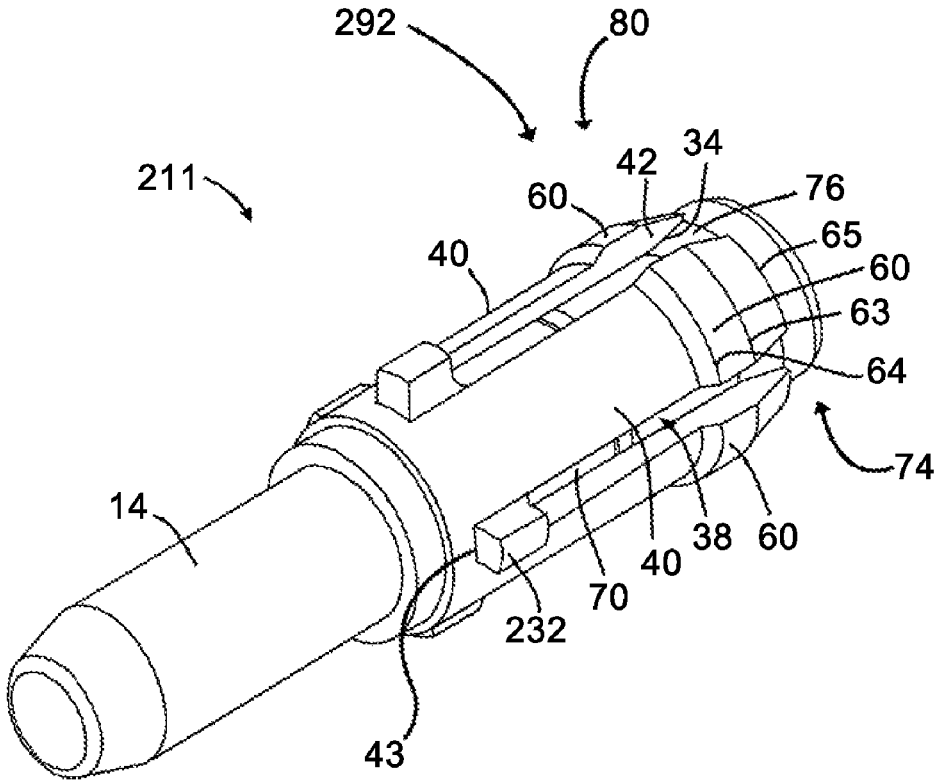
FIG. 11 shows a perspective view of the contact assembly of FIG. 9, in a second position of interference.
Figure 12:
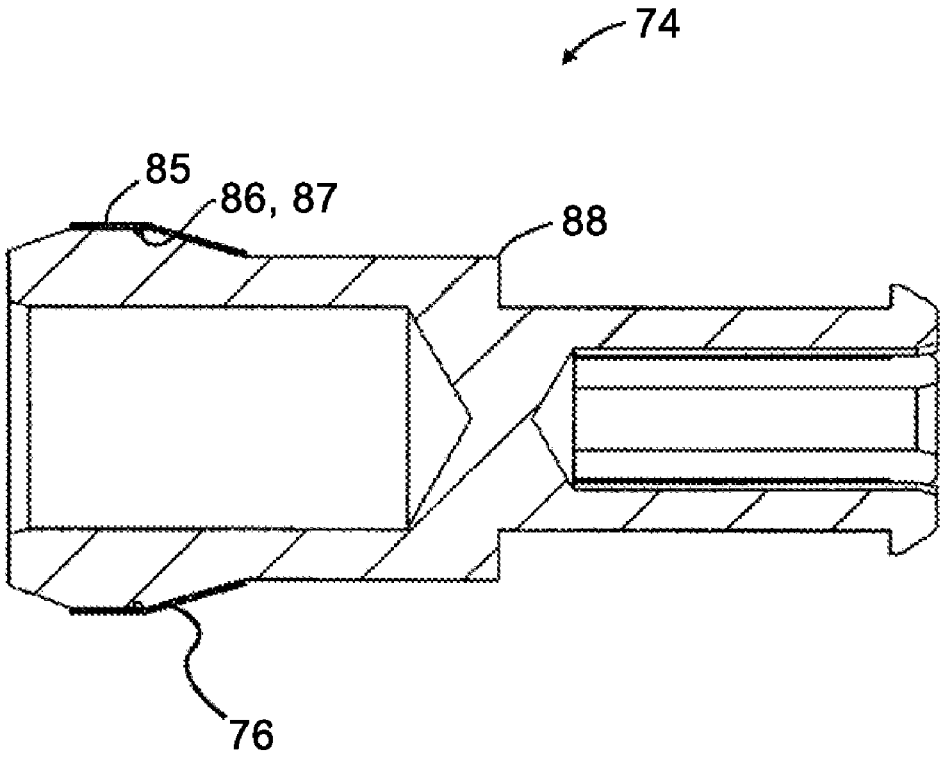
FIG. 12 shows a cross sectioned view of a flanged guide, according to one embodiment of the present invention.

A contact assembly 11 is positioned between a first insulator 13 and a second insulator 16. In the illustrated embodiment, the contact assembly 11 may be comprised of two components, a pin 14 and a guide 15. In other embodiments, the contact assembly 11 may be comprised of more than two components. Exemplary embodiments are illustrated in FIGS. 6 and 11. The contact assembly 11, the first insulator 13, the second insulator 16, and a sliding retainer 12 are inserted into the forward end 24 of the outer body 19. In the embodiment shown, the sliding retainer 12 is preferably constructed from a conductive material such as metal, and the sliding retainer 12 is installed into the outer body 19 with an interference fit between the sliding retainer and the outer body 19. If there is adequate electrical contact between the outer body 19 and the fastener 18, the sliding retainer 12 may not need to be electrically conductive.

The term interference fit is used herein to describe a method of assembly that provides a retention force between the sliding retainer 12 and the outer body 19. This retention force may be created as a result of a dimensional interference between the sliding retainer 12 and the outer body 19. The retention force may also be created by other known methods, such as an adhesive, interlocking mechanical components, etc.

Figure 2:
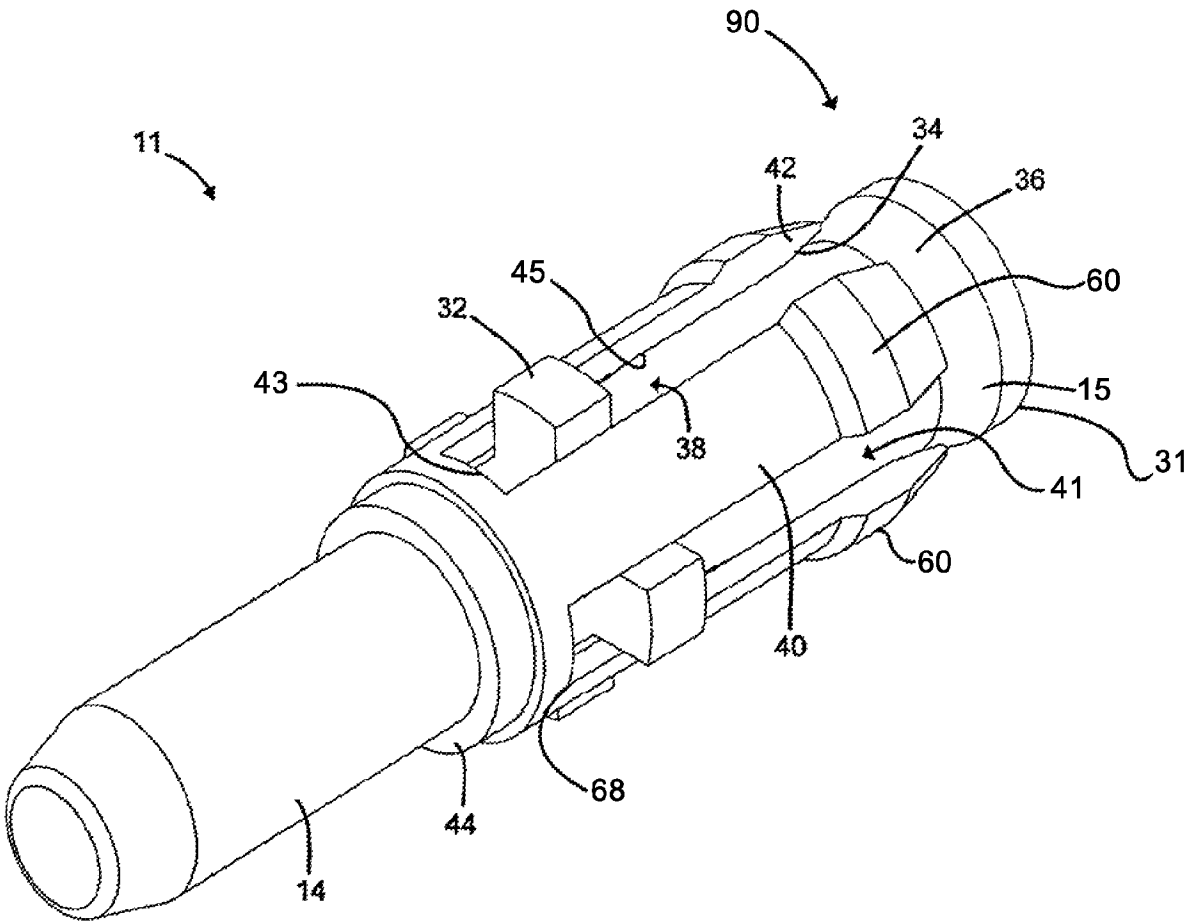
FIG. 2 shows a perspective view of a contact assembly according to an embodiment of the present invention in a first position of clearance.

Referring to FIG. 2, a contact assembly 11 is shown in a first position of clearance 90 such that the guide 15 is partially inserted into an internal cavity 41 of the pin 14. The pin 14 includes a plurality of finger-like support arms 40. In the illustrated embodiment, the support arms 40 extend radially from a single transverse plane on the pin 14. In other embodiments, the support arms 40 extend out from various locations along the length of the pin 14. The support arms 40 are circumferentially spaced about the pin 14. In one embodiment, four support arms 40 are evenly spaced about the axis of the pin 14. In another embodiment, one support arm 40 is present. In yet another embodiment, two support arms 40 are located opposite each other. In various other embodiments, a number of support arms 40 are circumferentially spaced apart various distances from each other. The space between the support arms 40 is a slot 38. The slot 38 is open at one end 42 of the support arms 40. The slot 38 terminates at a shoulder 43. The shoulder 43 is located along the length of the pin 14 at the base 68 of the support arms 40. The support arms 40 have an inward facing surface 45 defining the internal cavity 41.

The guide 15 is configured to fit into the internal cavity 41. The guide 15 may be inserted axially into the internal cavity 41. The guide 15 includes a plurality of tabs 32 configured to fit within the slots 38. The tabs 32 are sized to extend radially beyond the support arms 40 a distance sufficient to engage a mating surface 61 (FIGS. 4 and 5) on the second insulator 16. Each support arm 40 includes a ramped portion 34 on an underside of the end 42. The ramped portion 34 on the support arm 40 interacts with a ramped portion 36 at or near the flanged end 31 of the guide 15 opposite the tabs 32. A contact 60 is located on an outer surface of each support arm 40, the outer surface being the surface intended to directly face the tubular center conductor 30 within the hollow internal portion of the coaxial cable 28.

In the first position of clearance 90, shown in FIG. 2, the contact assembly 11 will slide into and out of the tubular center conductor 30 of the coaxial cable 28 (FIG. 4) with a relatively low moving force. The relatively low moving force will occur when the contacts 60 are pressed, even lightly, against the tubular center conductor 30 during assembly. It should be noted, that this relatively low moving force includes the possibility of a very low or no moving force being required to insert the contact assembly 11 if the contacts 60 on the pin 14 do not touch the tubular center conductor 30. For example, with this relatively low moving force, the contact assembly 11 can be slid into the hollow internal portion of the tubular center conductor 30 with less force than would be required if the contact assembly 11 were in the second position of interference 92, as illustrated in FIG. 3.

Figure 3:
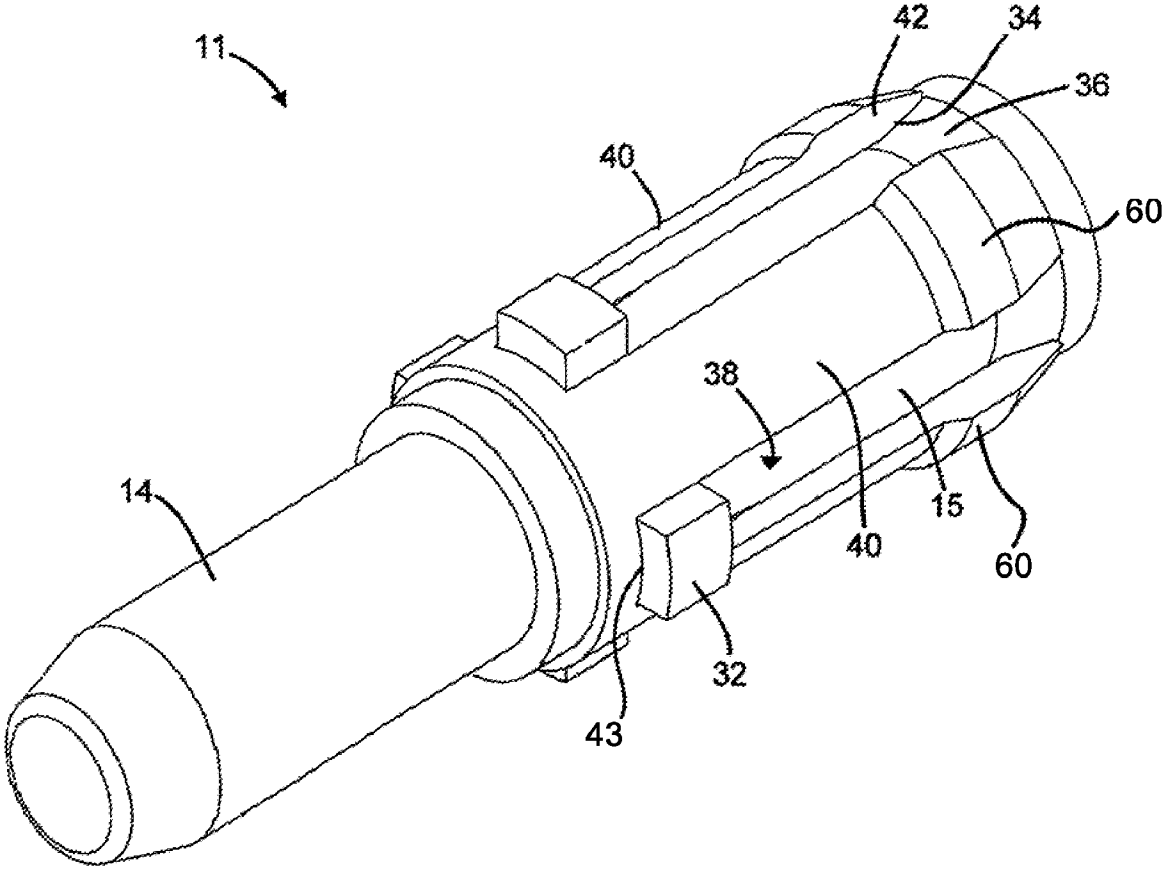
FIG. 3 shows a perspective view of the contact assembly of FIG. 4 in a second position of interference.

In the second position of interference 92 shown in FIG. 3, the ends 42 of support arms 40 and the contacts 60 are being supported by the ramped portions 34 of the support arms 40 interacting with the ramped portion 36 of the guide 15. This additional support provides additional contact pressure between the contacts 60 and the tubular center conductor 30. This additional contact pressure increases the moving force required to displace the contact assembly 11 within the tubular center conductor 30, the increased moving force being greater than the relatively low moving force described above in relation to the first position of clearance 90.

It is envisaged that the ends 42 of the individual support arms 40 will be moved outward by the transition of the guide 15 from the first position of clearance 90 to the second position of interference 92. It should be noted, however, that such movement of the support arms 40 and the contacts 60 is not required. For example, when the pin 14 is not inserted within the hollow inner portion of the tubular center conductor 30, the ends 42 of the support arms 40 may remain in the same or nearly the same position such that an effective diameter circumscribing the contacts 60 remains the same or nearly the same. In the second position of interference 92, the ends 42 of the support arms 40 may be supported more closely by the guide 15 such that the pressure required to deflect the contacts 60 to an inner diameter of the tubular center conductor 30 is greater than when the guide 15 is in the first position of clearance 90. It is this difference in contact pressure that changes the moving force required to displace the connector assembly within the tubular center conductor 30.

While, in FIG. 3, the tabs 32 are shown fully advanced, making contact with the shoulder 43, in the second position of interference 92, in practice, when transitioning from the first position of clearance 90 to the second position of interference 92, the tabs 32 approach the shoulder 43, but may not fully reach the shoulder 43 at the end of the slot 38.

Figure 4:
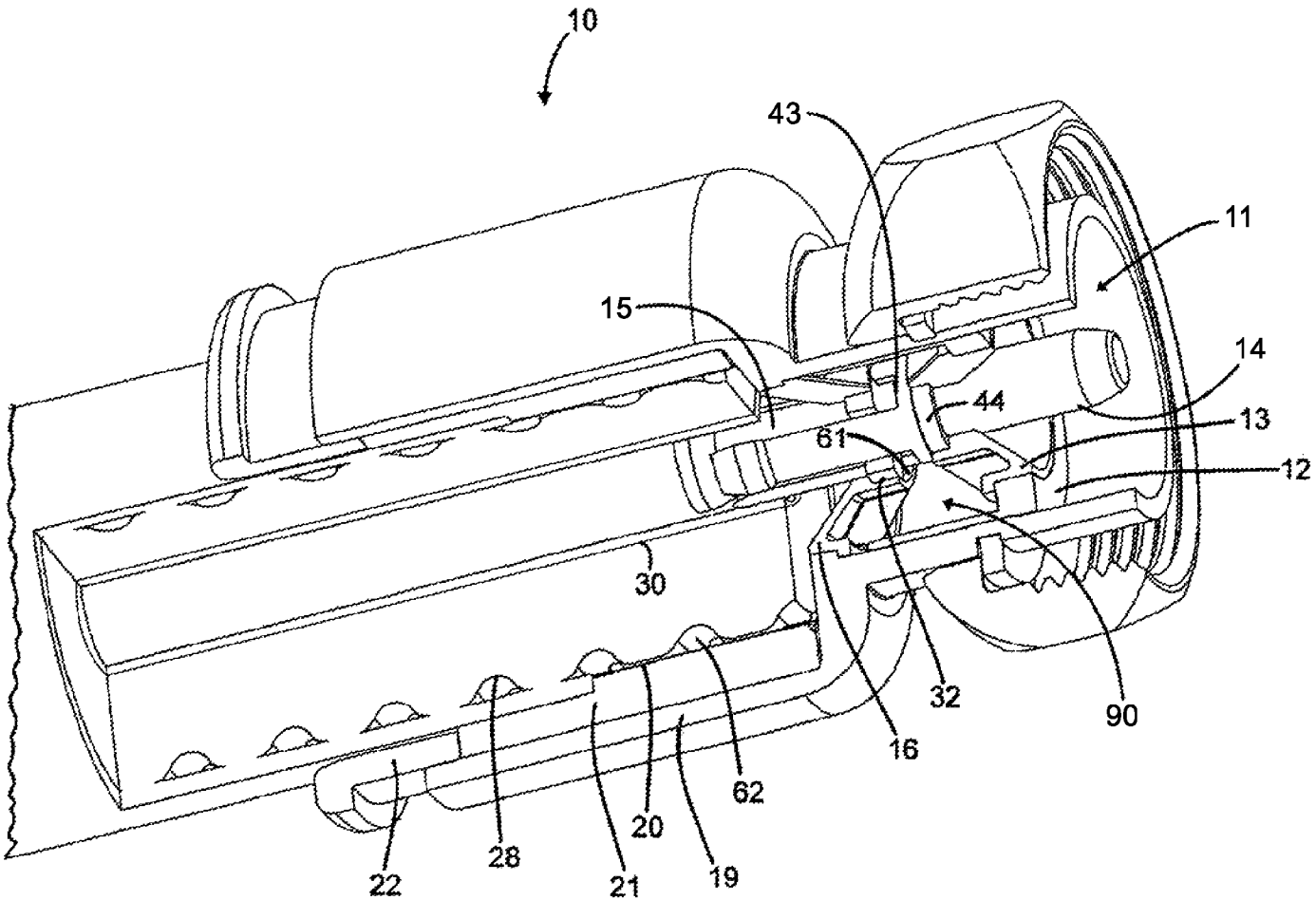
FIG. 4 shows a partial cutaway perspective view of a hard line connector according to an embodiment of the invention which is in a first position of clearance within a tubular center conductor of a hard line coaxial cable.

Referring now to FIG. 4, a coaxial cable 28, which includes a tubular center conductor 30, is attached to the connector 10 as follows. The mesh body 20, the elastomeric clamp 21, and the compression sleeve 22 are removed from the outer body 19. A portion of an outer conductor 62 of the coaxial cable 28 is exposed for contact with the mesh body 20. The coaxial cable 28 is then inserted through the compression sleeve 22, the elastomeric clamp 21, and the mesh body 20 with the mesh body 20 positioned close to the end of the coaxial cable 28. A portion of the coaxial cable 28 is then positioned within the outer body 19 and the compression sleeve 22 is forced into the outer body 19, squeezing the elastomeric clamp 21 and the mesh body 20 into the outer conductor 62 of the coaxial cable 28. The coaxial cable 28 is held in place within the connector 10 as a result of an axial compression of the compression sleeve 22.

Figure 5:
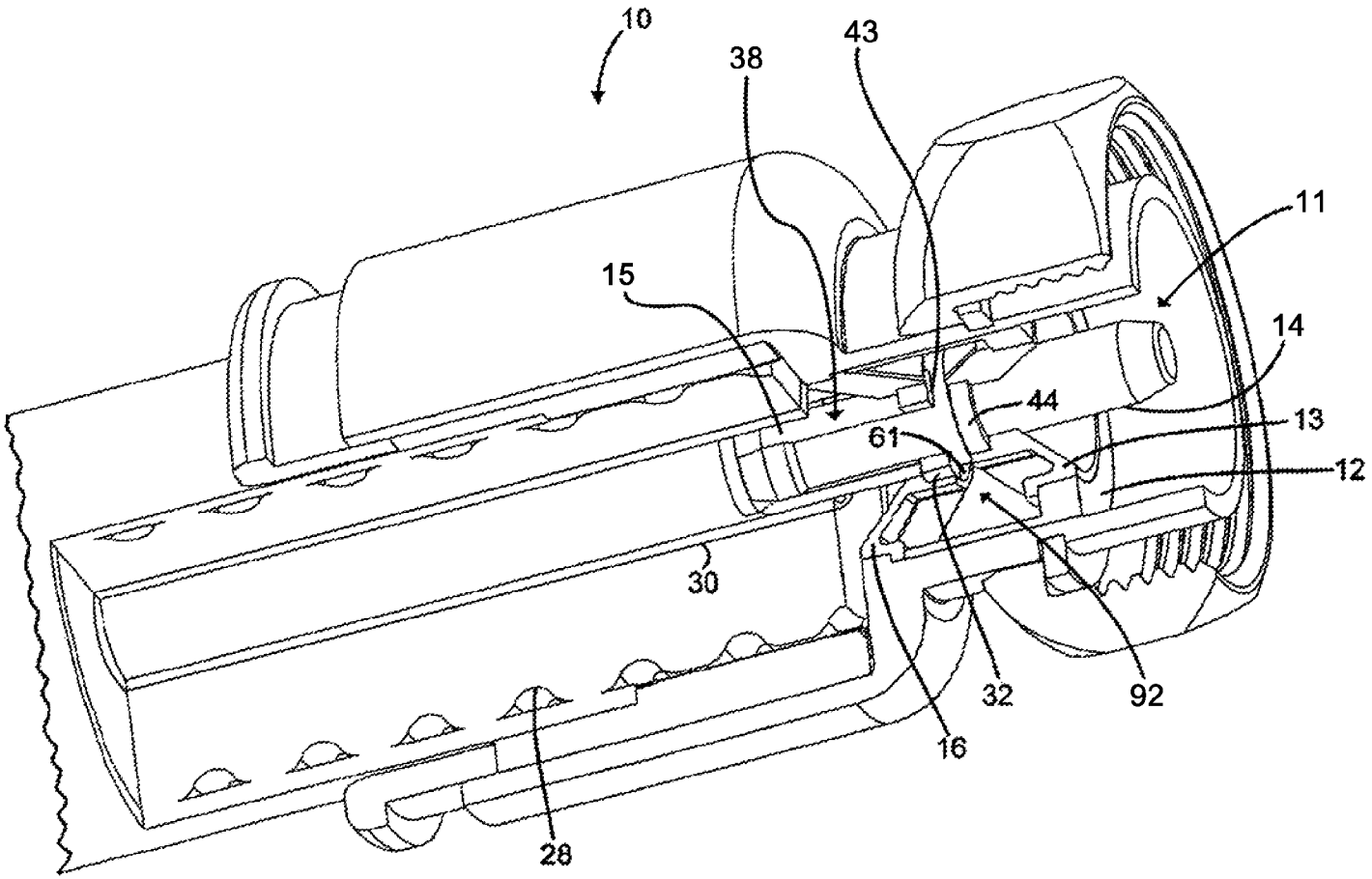
FIG. 5 shows a partial cutaway perspective view of the hard line connector of FIG. 4 that is in a second position of interference within the tubular center conductor of a hard line coaxial cable.

Referring further to FIGS. 4 and 5, the contact assembly 11 is moved from the first position of clearance 90 to the second position of interference 92 when the sliding retainer 12 is pushed toward the coaxial cable 28. The movement of the sliding retainer 12 repositions the first insulator 13 in relation to the second insulator 16. The first insulator 13 engages a ridge 44 located on the pin 14 to move the pin 14 toward the guide 15. Accordingly, the shoulder 43 of the contact assembly 11 is pushed toward tabs 32 of the contact assembly 11 forming the second position of interference 92. While, in FIG. 5, the tabs 32 are shown fully advanced, making contact with the shoulder 43, in the second position of interference 92, in practice, when transitioning from the first position of clearance 90 to the second position of interference 92, the tabs 32 approach the shoulder 43, but may not fully reach the shoulder 43 at the end of the slot 38.

Referring now to FIG. 6, another embodiment of a contact assembly 111 is shown in exploded form. The contact assembly 111 includes a pin 46, a guide 50, and a cylindrical collar 57. Similar to pin 14 described above, the pin 46 includes a plurality of finger-like support arms 47. In the illustrated embodiment, the support arms 47 extend radially from a single transverse plane on the pin 46. In other embodiments, the support arms 47 extend out from various locations along the length of the pin 46. The support arms 47 are circumferentially spaced about the pin 46. In one embodiment, four support arms 47 are evenly spaced about the axis of the pin 46. In another embodiment, one support arm 47 is present. In yet another embodiment, two support arms 47 are located opposite each other. In various other embodiments, a number of support arms 47 are circumferentially spaced apart various distances from each other. The space between the support arms 47 is a slot 49. The slot 49 is open at one end 48 of the support arms 47. The slot 49 terminates at a shoulder 143. The shoulder 143 is located along the length of the pin 46 at the base 168 of the support arms 47. The support arms 47 have an inward facing surface 145 defining the internal cavity 141. The guide 50 is similar to the guide 15 described above in that it is configured to fit into the internal cavity 141 formed by the inward facing surface 145 of the support arms 47. The guide 50 may be inserted axially into the internal cavity 141. The guide 50 includes a plurality of tabs 55, which fit within the slots 49. The tabs 55 are sized to extend radially beyond the support arms 47 of the pin 46 to engage a mating surface 61 (FIGS. 4 and 5) on the second insulator 16. The tabs 55 are disposed on one end of a shaft portion 54, and a radially extending flange 56 is disposed on the opposite end thereof.

The cylindrical collar 57 is configured to be concentrically disposed over the shaft portion 54 of the guide 50. The cylindrical collar 57 is of a length such that the tabs 55 are adjacent one end 58 and the flange 56 is adjacent the other end 59. The cylindrical collar 57 is composed of a material that has a relatively low Young's modulus of between 1 and 25 MPa, like natural rubber, nitrile rubber, silicone rubber, styrene butadiene rubber, ethylene propylene diene rubber, urethane rubber, etc. Elastomers having a relatively low Young's modulus can be elastically compressed in an axial direction to create a radial deflection of the elastomer with a relatively low compressive force. Such elastomers should also have relatively low compressibility properties such that the material maintains a relatively consistent volume during an elastic deflection. This characteristic allows for an efficient transfer of an axial deflection into a radial deflection. It has been found that silicone rubber is a suitable material for the cylindrical collar 57.

The term "relatively" is used above in an effort to define the desired properties of the cylindrical collar 57 while allowing design modifications that are envisaged to be within the scope of the present invention. In other words, it is envisaged that the cylindrical collar 57 could be manufactured of a more ridged and more compressible material. In the case of a more ridged material, the cylindrical collar 57, in one embodiment, could have a thinner cross section as a means to compensate for the less desirable material properties. In another scenario, the installation tools could be made to provide a greater amount of installation force. Similarly, it is envisaged that a more compressible material could be used for the cylindrical collar 57 when less actual radial deflection is desired for a given axial deflection.

Figure 7:
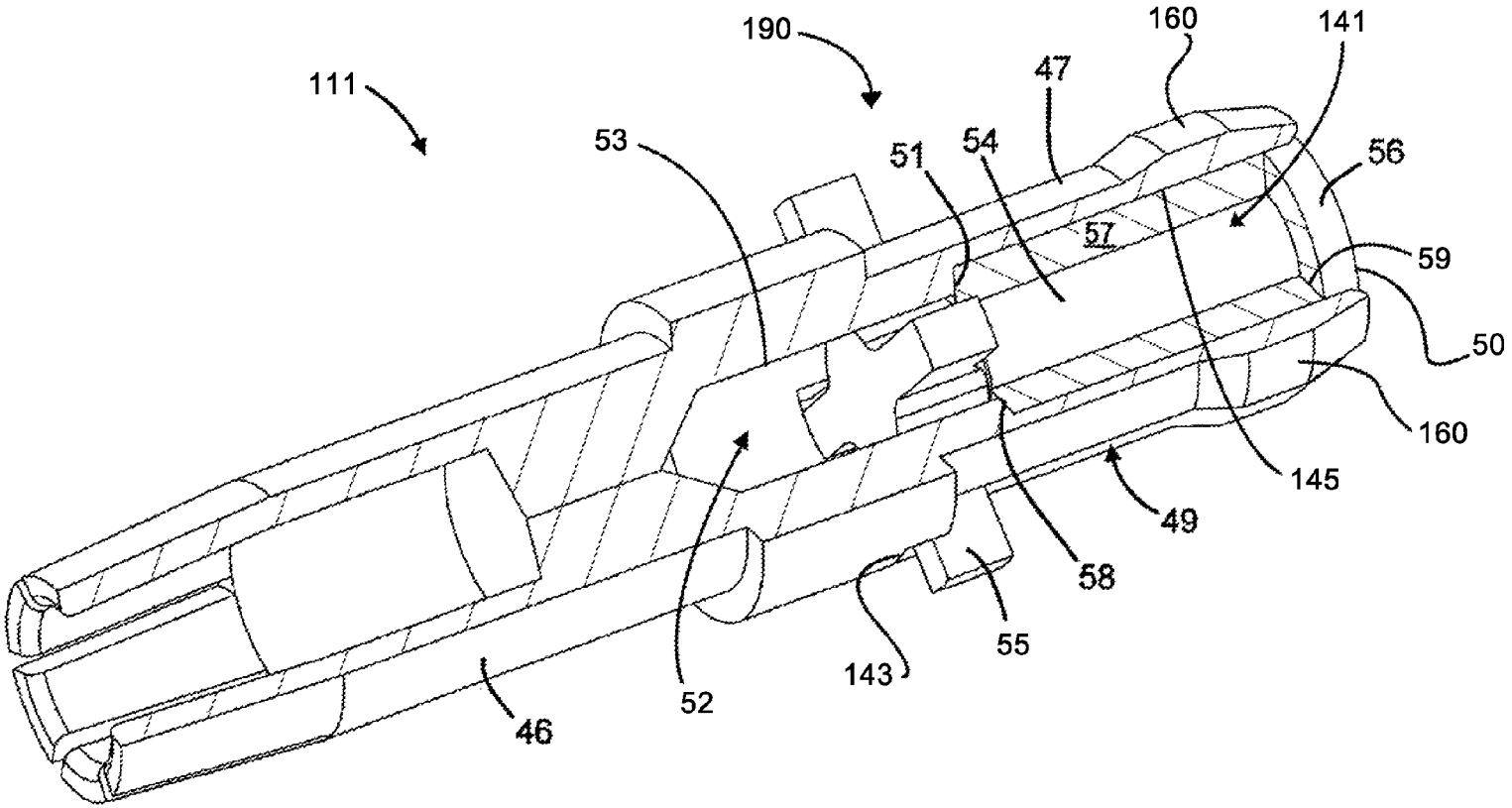
FIG. 7 shows a perspective cutaway view of the contact assembly of FIG. 6 in a first position of clearance.

Referring now to FIG. 7, the partial sectioned view of contact assembly 111 in the first position of clearance 190. The cross-section of the pin 46 reveals an inner chamber 52 bounded radially by a wall 53. The transition from the inner chamber 52 to the larger internal cavity 141 is marked by an inner shoulder 51. The cylindrical collar 57, which is mounted on the shaft portion 54 of the guide 50, may be axially inserted into the internal cavity 141 defined by the inward facing surface 145 of the support arm 47. The end 58 of the cylindrical collar 57 abuts the inner shoulder 51, and the other end 59 of the cylindrical collar 57 is engaged by the flange 56 of the guide 50. The tabs 55 do not contact the shoulder 143 of the slots 49, but are spaced therefrom. In this first position of clearance 190, the cylindrical collar 57 is exerting relatively little, if any, force against the support arms 47. Similar to the contact assembly 11 discussed above, the contacts 160 of the contact assembly 111 may be inserted into the hollow internal portion of a tubular center conductor 30 using the relatively low moving force when the contact assembly 111 is in the first position of clearance 190.

Figure 8:
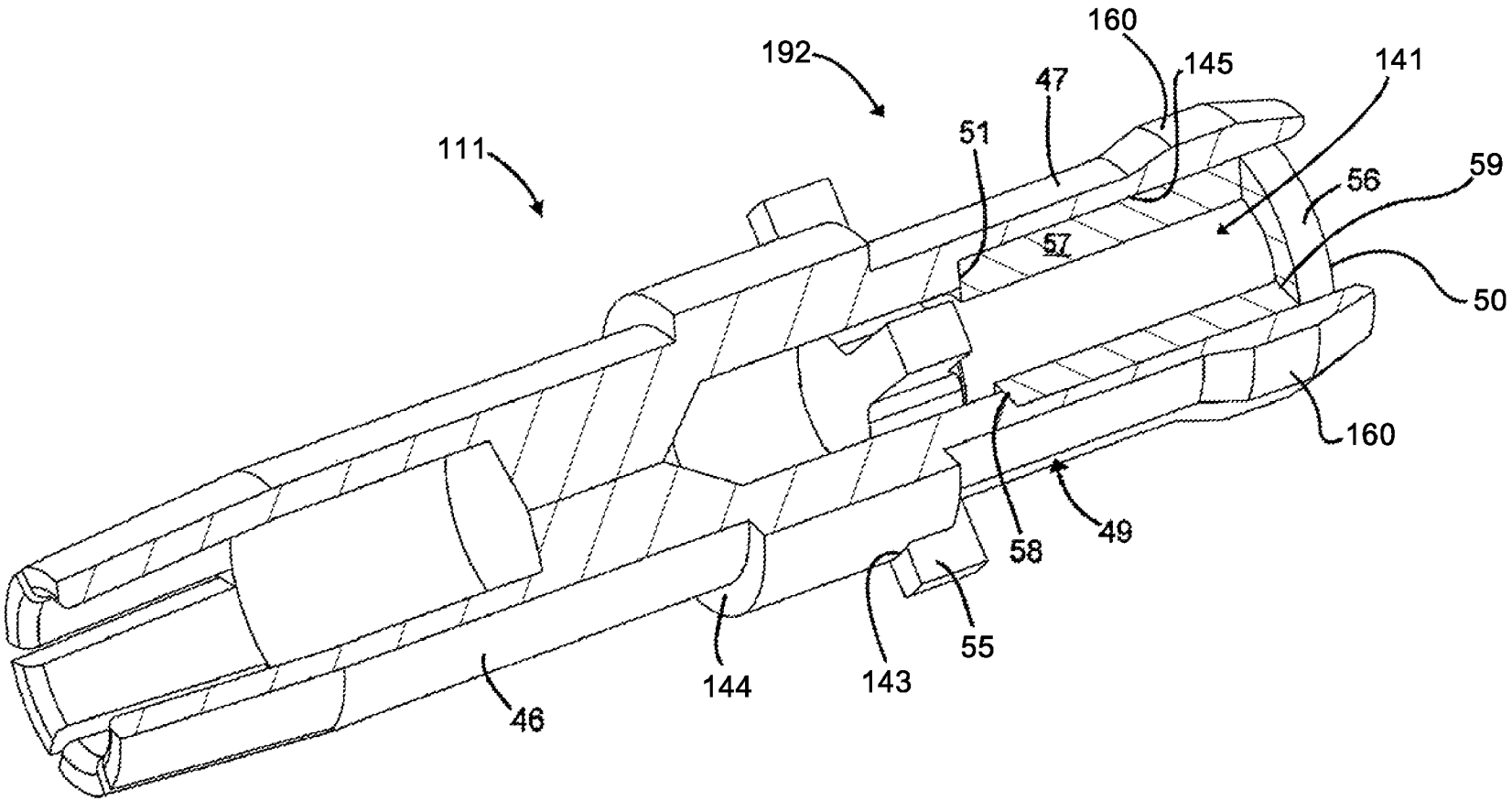
FIG. 8 shows a perspective cutaway view of the contact assembly of FIG. 6 in a second position of interference.

In the second position of interference 192 of the contact assembly 111 shown in FIG. 8, the guide 50 is moved in relation to the pin 46. As the guide 50 moves further into the internal cavity 141, the flange 56 abutting the end 59 of the cylindrical collar 57 presses the opposing end 58 against the internal shoulder 51 compressing the cylindrical collar 57. In this way, the cylindrical collar 57 expands radially outward to press against the support arms 47. The contacts 160 on the support arms 47 are firmly held into position or forced outward by the radial expansion of the cylindrical collar 57. Accordingly, the contacts 160 may apply increased pressure against the hollow internal portion of the tubular center conductor 30. As discussed above, in relation to the contact assembly 11, the additional contact pressure will increase the moving force required to displace the contact assembly 111 within the tubular center conductor 30.

Similar to the contact assembly 11 in the connector 10 shown in FIGS. 4 and 5, the relative axial movement within the contact assembly 111 between the shoulder 143 and the tabs 55 is initiated by an axial movement of the sliding retainer 12. The movement of the sliding retainer 12 toward the coaxial cable 28 repositions the first insulator 13 in relation to the second insulator 16. The first insulator 13 engages a ridge 144 located on the pin 46 to move the pin 46 toward the guide 50. Accordingly, the shoulder 143 of the contact assembly 111 is pushed toward tabs 55 of the contact assembly 111 forming the second position of interference 192. While, in FIG. 8, the tabs 55 are shown fully advanced, making contact with the shoulder 143, in the second position of interference 192, in practice, when transitioning from the first position of clearance 190 to the second position of interference 192, the tabs 55 approach the shoulder 143, but may not fully reach the shoulder 143 at the end of the slot 49.

Similar to the discussion of the contact assembly 11 above, it is envisaged that contacts 160 of the individual support arms 47 will be moved outward by the transition of the guide 50 from the first position of clearance 190 to the second position of interference 192. It should be noted, however, that such movement of the support arms 47 and the contacts 160 is not required. For example, when the pin 46 is not inserted within the hollow inner portion of the tubular center conductor 30, the contacts 160 of the support arms 47 may remain in the same or nearly the same position such that an effective diameter circumscribing the contacts 160 remains the same or nearly the same. In the second position of interference 192, the contacts 160 of the support arms 47 may be supported more closely by the guide 50 and the cylindrical collar 57 such that the pressure required to deflect the contacts 160 to an inner diameter of the tubular center conductor 30 is greater than when the guide 50 is in the first position of clearance 190. It is this difference in contact pressure that changes the moving force required to displace the contact assembly 111 within the tubular center conductor 30.

As will be understood, because of the flexibility of the cylindrical collar 57, there exists a range of possible motion of the support arms 47 in the radial direction. In this way, the same connector 10 can be used with coaxial cables having internal diameters that vary due to manufacturing tolerance and/or corrugations.

Figure 9:
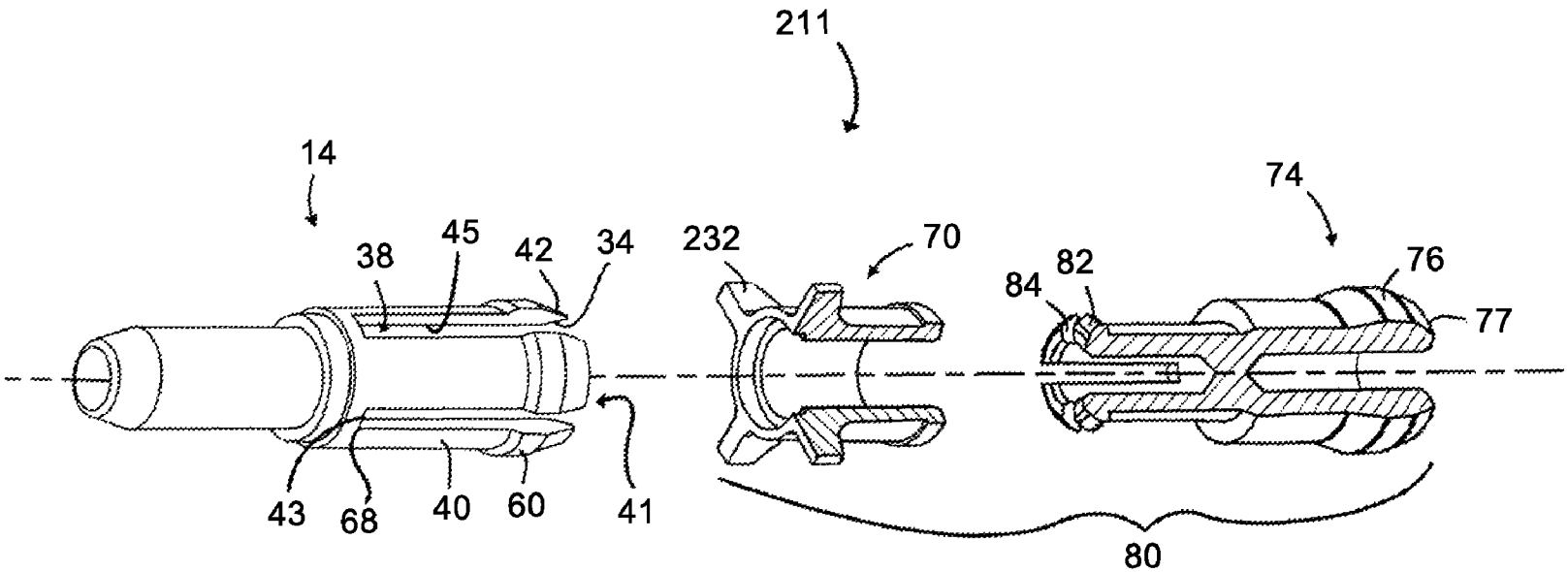
FIG. 9 shows an exploded view of a contact assembly according to one embodiment of the present invention, wherein the tabbed guide and a flanged guide are partially sectioned.

FIGS. 9-13 illustrate embodiments of the contact assembly 211 which can address, reduce, or eliminate the "hanging" reverse path for RF propagation. FIG. 9 shows an exploded partially sectioned view of a contact assembly 211 comprising a pin 14 and a guide 80. The guide 80 is a two-piece assembly comprising a tabbed guide 70 and the flanged guide 74. The pin 14 includes a plurality of finger-like support arms 40. In the illustrated embodiment, the support arms 40 extend radially from a single transverse plane on the pin 14. In other embodiments, the support arms 40 extend out from various locations along the length of the pin 14. The support arms 40 are circumferentially spaced about the pin 14. In one embodiment, four support arms 40 are evenly spaced about the axis of the pin 14. In another embodiment, one support arm 40 is present. In yet another embodiment, two support arms 40 are located opposite each other. In various other embodiments, a number of support arms 40 are circumferentially spaced apart various distances from each other. The space between the support arms 40 is a slot 38. The slot 38 is open at one end 42 of the support arms 40. The slot 38 terminates at a shoulder 43. The shoulder 43 is located along the length of the pin 14 at the base 68 of the support arms 40. The support arms 40 have an inward facing surface 45 defining the internal cavity 41.

The tabbed guide 70 is configured to fit into the internal cavity 41 of the pin 14. The tabbed guide 70 may be inserted axially into the internal cavity 41. The tabbed guide 70 includes a plurality of corresponding tabs 232 that fit within the slots 38 of the pin 14. The tabs 232 are sized to extend radially beyond the slots 38 a distance sufficient to engage a mating surface 61 (FIGS. 4 and 5) on the second insulator 16 (FIGS. 1, 4, and 5). The tabbed guide 70 can be comprised of a material that electrically conducts or electrically insulates. Making the tabbed guide 70 out of the same electrically conductive material as other components of the contact assembly 211 or connector 10 might save money or have other manufacturing benefits, while making the tabbed guide 70 out of an electrically insulating material might reduce or prevent return loss that might occur through electrically conductive contact between the tabs 232 and the second insulator 16.

The flanged guide 74 includes a flange 76, which may be ramped. The flange 76 is located at or near an end 77 of the flanged guide 74. The flanged guide 74 is configured to be fixably inserted into the tabbed guide 70. In one embodiment, as seen in FIG. 9, the flanged guide 74 is configured to slide into the tabbed guide 70. The flanged guide 74 may include locking tabs 82 with an inclined exterior surface. Slots 84 exist between the locking tabs 82, so that the interior radius of the tabbed guide 70 deflects the locking tabs 82 elastically and radially inward as the flanged guide 74 is inserted into the tabbed guide 70. When the flanged guide 74 reaches a position of full insertion and the locking tabs 82 are extended through the flanged guide 74, the locking tabs 82 become free to return radially outward to a non-deflected position and lock the flanged guide in place. In the locked position, the flanged guide 74 is restricted from sliding back out of the fully inserted position or further into the tabbed guide 70.

Other mechanisms known in the art can also be used to temporarily or permanently lock the flanged guide 74 to the tabbed guide 70. For example, in one embodiment, the flanged guide 74 might have a continuous cylindrical end, and after full insertion, the end emerging through the tabbed guide 70 might be crimped. In another exemplary embodiment, the flanged guide 74 can have external threads, the tabbed guide 70 can have internal threads, and the flanged guide 74 can be threaded into the tabbed guide 70. In yet another exemplary embodiment, the flanged guide 74 can have internal threads, the tabbed guide 70 can have external threads, and the tabbed guide 70 can be threaded into the flanged guide 70.

Figure 10:
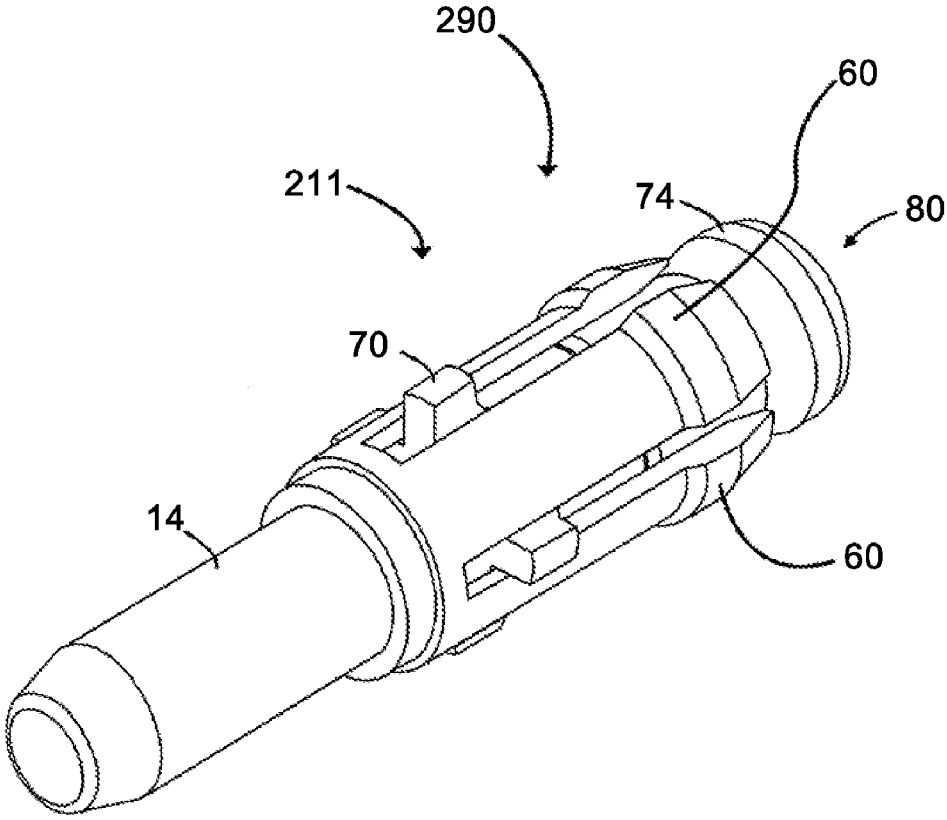
FIG. 10 shows a perspective view of a contact assembly of FIG. 9 in a first position of clearance.

FIG. 10 shows a perspective view of the contact assembly 211 according to one embodiment of the present invention in a first position of clearance 290. In the first position of clearance 290, the contact assembly 211 will slide into and out of the tubular center conductor 30 of the coaxial cable 28 (FIG. 4) with a relatively low moving force. The relatively low moving force will occur when the contacts 60 are pressed, even lightly, against the tubular center conductor 30 during assembly. It should be noted, that this relatively low moving force includes the possibility of a very low or no moving force being required to insert the contact assembly 211 if the contacts 60 on the pin 14 do not touch the tubular center conductor 30. For example, with this relatively low moving force, the contact assembly 211 can be slid into the hollow internal portion of the tubular center conductor 30 with less force than would be required if the contact assembly 211 were in the second position of interference 292, as illustrated in FIG. 11.

FIG. 11 shows a perspective view of the contact assembly 211 according to one embodiment of the present invention in a second position of clearance 292, in which the assembled guide 80 is fully inserted within the pin 14. In the second position of interference 292, the ends 42 of support arms 40 and the contacts 60 are being supported by the ramped portions 34 of the support arms 40 interacting with the flange 76. This additional support provides additional contact pressure between the contacts 60 and the tubular center conductor 30. This additional contact pressure increases the moving force required to displace the contact assembly 211 within the tubular center conductor 30, the increased moving force being greater than the relatively low moving force described above in relation to the first position of clearance 290.

It is envisaged that the ends 42 of the individual support arms 40 will be moved outward by the transition of the guide 80 from the first position of clearance 290 to the second position of interference 292. It should be noted, however, that such movement of the support arms 40 and the contacts 60 is not required. For example, when the pin 14 is not inserted within the hollow inner portion of the tubular center conductor 30, the ends 42 of the support arms 40 may remain in the same or nearly the same position such that an effective diameter circumscribing the contacts 60 remains the same or nearly the same. In the second position of interference 292, the ends 42 of the support arms 40 may be supported more closely by the flange guide 74 such that the pressure required to deflect the contacts 60 to an inner diameter of the tubular center conductor 30 is greater than when the guide 80 is in the first position of clearance 290. It is this difference in contact pressure that changes the moving force required to displace the connector assembly within the tubular center conductor 30.

While, in FIG. 11, the tabs 232 are shown fully advanced, making contact with the shoulder 43, in the second position of interference 292, in practice, when transitioning from the first position of clearance 290 to the second position of interference 292, the tabs 232 approach the shoulder 43, but may not fully reach the shoulder 43 at the end of the slot 38.

With further reference to FIG. 11, the flanged guide 74 and the flange 76 are comprised of an electrically conductive material. Therefore, when one contact 60 contacts the center tubular conductor 30 closer to a tip 63 of the respective contact 60, while another contact 60 contacts the center tubular conductor 30 (FIG. 3) closer to a base 64 of the respective contact 60, or when two contacts 60 otherwise contact the center tubular conductor 30 (FIG. 5) in different axial locations (e.g. at locations not equidistant axially from the end 65 of the support arms 40), then the connection between the contacts 60 and the flanged guide 74 in a common axial location reduces or eliminates the undesirable RF effect on the performance of the connector. The "hanging" reverse path for RF propagation is reduced or eliminated and the overall transmission efficiency of the connector 10 is maintained.

A common axial connection between the contacts 60 and the flanged guide 74 can be achieved in alternate embodiments. For instance, referring to FIG. 12, which shows a cross sectioned view of the flanged guide 74, according to one alternative embodiment of the present invention, the flanged guide 74 may be made of an electrically nonconductive material, such as a plastic. In this embodiment, an electrically conductive sleeve 85 can be positioned over the flange 76, or a portion of the flange 76, where contact is made with the under side of the contacts 60. The sleeve 85 can be held in place in a variety of manners. The illustrated example shows an annular rib 86 on the sleeve 85, which can snap or fit into an annular groove or notch 87 on the flanged guide 74. The rib 86 can alternatively be semi-annular, or be a single point. There can also be a series of ribs 86 spaced axially or spaced around the same diameter. The sleeve 85 can extend over an end of the flanged guide 74, or over a corner, such as corner 88. Other alternative methods of fastening the sleeve 85 to the flange 76 are available, as would be recognized by one of skill in the art.

Furthermore, rather than using the sleeve 85, the flanged guide 74 can be plated with an electrically conductive material, in whole or at least to cover the portion of the flange 76 where contact with the contacts 60 occurs.

Figure 13:
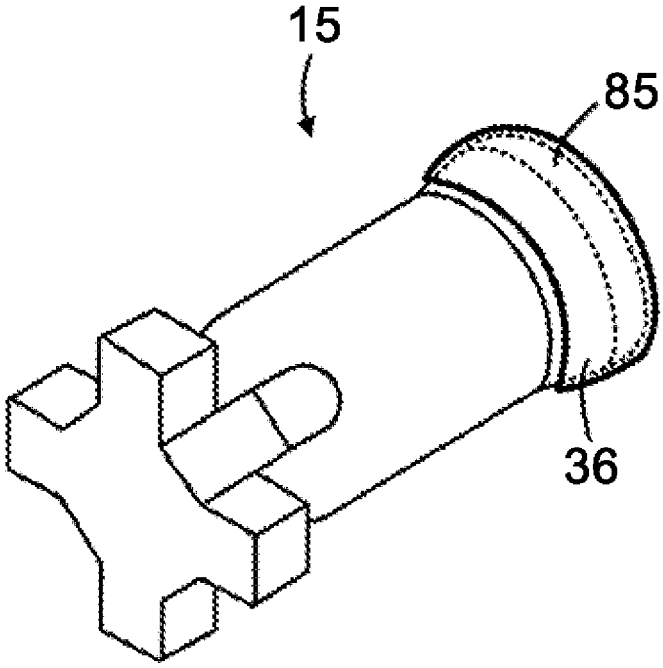
FIG. 13 shows a perspective view of a guide, according to one embodiment of the present invention.

FIG. 13 shows a perspective view of the guide 15 according to another alternative embodiment of the present invention. As with the flanged guide 74, the guide 15, being made of a nonconductive material, can use either an electrically conductive sleeve 85 or electrically conductive plating 85 to cover at least a portion of the ramped portion 36, where contact between the guide 15 and the under side of the contacts 60 occurs.

In another alternative embodiment, the guide 15 can simply be fabricated from metal. However, using a tabbed guide 70 that is nonconductive and/or a guide 15 that is nonconductive with a conductive portion, such as conductive metal plating or a conductive metal sleeve 85, reduces or avoids return loss that can possibly occur when the guide 15 and/or tabbed guide 70 are fabricated from metal.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

I claim:

1. A coaxial cable connector comprising:

a connector body having a central axis;

a pin having a first end, a second end, and a plurality of circumferentially spaced support arms terminating at the second end, the support arms each having an inward facing surface that define a first internal cavity;

a first insulator located within the connector body, the first insulator configured to receive the pin, wherein the pin is aligned with the central axis;

a second insulator located within the connector body, the second insulator having an opening; and a guide configured to fit within the opening of the second insulator, wherein the guide is aligned with the central axis, the guide being axially received in the first internal cavity, the guide comprising a tabbed component and a flanged component, the tabbed component having a first tubular body defining a second internal cavity, the tabbed component having a plurality of tabs which fit into respective slots formed between the support arms, each tab in the plurality of tabs being electrically insulating, the flanged component having a generally radially extending flange, a ramped flange, and a second tubular body, the second tubular body extending into the second internal cavity of the tabbed component, the radially extending flange having an electrically conductive contact surface that contacts the inward facing surface of each of the support arms;

wherein the ramped flange is at least partially plated with an electrically conductive material.

2. The coaxial cable connector as set forth in claim 1, wherein the electrically conductive contact surface that contacts the inward facing surface of each of the support arms is comprised of an electrically conductive sleeve at least partially covering the radially extending flange.

3. The coaxial cable connector as set forth in claim 1, wherein the electrically conductive contact surface that contacts the inward facing surface of each of the support arms is comprised of an electrically conductive sleeve at least partially plated with an electrically conductive material.

4. The coaxial cable connector as set forth in claim 1, wherein the flanged component is comprised of an electrically conductive material.

5. The coaxial cable connector as set forth in claim 1, wherein the ramped flange is at least partially covered by an electrically conductive sleeve.

6. The coaxial cable connector as set forth in claim 1, wherein the pin and the guide are components within a cable connector which connects to a coaxial cable having a tubular center conductor, wherein, in a first position, the pin and the guide are moveable into and out of the tubular center conductor by a relatively low moving force, and wherein, in a second position, the support arms and the contacts formed thereon are pressed radially outwardly to a greater degree than in the first position, a pressure of the contacts against the tubular center conductor creates a moving force that is greater than the relatively low moving force.

7. The coaxial cable connector as set forth in claim 6, further including a shoulder located at a closed end of the slots, wherein at least one of the plurality of tabs are fully seated against the shoulder in the second position.

8. A coaxial cable connector comprising:

a connector body having a central axis, a pin having a first end and a second end, the pin having a plurality of circumferentially spaced support arms terminating at the second end, and inward facing surfaces of the support arms defining a first internal cavity;

a first insulator located within the connector body, the first insulator configured to receive the pin, wherein the pin is aligned with the central axis;

a first guide being axially received in the internal cavity, the first guide having a first tubular body defining a second internal cavity, the first guide having a plurality of tabs which fit into respective slots formed between the support arms, each tab in the plurality of tabs is electrically insulated;

a second insulator located within the connector body, the second insulator having an opening; and a second guide configured to fit within the opening of the second insulator, wherein the second guide is aligned with the central axis, the second guide having an insertion end and a flanged end opposite the insertion end, the insertion end being axially received in the second internal cavity, and the flanged end having a generally radially extending flange, a ramped flange, and a second tubular body extending in the second internal cavity of the first guide, the radially extending flange having an electrically conductive contact surface that contacts the inward facing surfaces of the support arms;

wherein the ramped flange is at least partially plated with an electrically conductive material.

9. The coaxial cable connector as set forth in claim 8, wherein the radially extending flange is at least partially covered with an electrically conductive sleeve.

10. The coaxial cable connector as set forth in claim 8, wherein the second guide is comprised of an electrically conductive material.

* * * * *